United States Patent [19]
Nash et al.
[11] 3,934,833
[45] Jan. 27, 1976

[54] HYSTERESIS CLUTCH FOR FILM WINDING

[75] Inventors: James L. Nash, Glens Falls; Phillip H. Carrico, Greenfield Center, both of N.Y.

[73] Assignee: General Electric Company, Hudson Falls, N.Y.

[22] Filed: Sept. 27, 1974

[21] Appl. No.: 510,114

[52] U.S. Cl. ..... 242/56.9
[51] Int. Cl.[2] ..... B65H 19/04
[58] Field of Search ..... 242/56.9, 46.4, 46.21, 242/75.5, 56.2

[56] References Cited

UNITED STATES PATENTS

| | | | |
|---|---|---|---|
| 1,236,965 | 8/1917 | Miller | 242/46.21 |
| 2,310,153 | 2/1943 | Rosenfarb | 242/56.2 |
| 2,746,691 | 5/1956 | Hood | 242/55.14 |
| 3,622,096 | 11/1971 | Young | 242/56.9 |
| 3,712,554 | 1/1973 | Lorenzini | 242/56.2 |

*Primary Examiner*—Edward J. McCarthy

[57] ABSTRACT

This invention relates to a permanent magnet hysteresis clutch means to transmit torque from a driving mandrel to a film strip winding bobbin or core, and more particularly to a plurality of hysteresis clutch means which are arranged in spaced array to simultaneously transmit torque to a plurality of film winding bobbins where the bobbins are of varying widths.

6 Claims, 2 Drawing Figures

HYSTERESIS CLUTCH FOR FILM WINDING

BACKGROUND OF THE INVENTION

Polypropylene film is usually produced by the bubble or blown tube process or by a draft and tentering process. In each process, the polypropylene is continually produced on a very wide sheet which may be, for example, 1–3 meters wide and perhaps as thin as from 3.0 to 25 microns. For use in electrical capacitors, this film sheet is usually simultaneously slit to a number of smaller widths, and this slitting takes place as an adjunct to the film production equipment where the slitting mechanism receives film as produced from the film production equipment. It is preferred to slit the film directly from the mill roll simultaneously into as many as thirty-two or more strips which are also simultaneously wound on winding cores driven by a common mandrel to provide suitable film bobbins. Slip clutches are usually provided at a drive means between the driving mandrel and each of the winding cores. Simultaneous winding of plural film bobbins gives rise to a number of major problems such as film tension control and bobbin alignment. Variations in film thicknesses, i.e., off gauge conditions, adversely affect film tension, which for very narrow width film strips require quite precise limitations. The normal force which is usually necessary to generate the required friction for friction drive through slip clutches must ordinarily be applied to the ends of each of the plurality of cores, and this results in a general misalignment from core to core or bobbin to bobbin which is reflected in an oscillation of the tension applied to the narrow webs. This oscillation is often so great as cause the tension to vary by as much as 50 percent thus resulting in poor bobbin edges and generally lack of control over the winding process.

OBJECTS OF THE INVENTION

It is thus an object of this invention to provide improved drive means between a driving mandrel and a plurality of winding cores mounted thereon.

It is a further object of this invention to provide non friction magnetic drive between the driving mandrel and individual ones of a plurality of film winding cores mounted on said mandrel.

It is a further object of this invention to utilize permanent magnet hysteresis clutch means between a plurality of winding cores and their common driving mandrel.

SUMMARY OF INVENTION

In a preferred form of this invention, a drive shaft or mandrel has mounted thereon for individual concentric rotation thereabout a plurality of winding cores upon which synthetic resin films of varying widths are wound. Between each winding core and the driving mandrel, there is positioned a permanent magnet hysteresis clutch means which transmits the driving torque from the driving mandrel to the core by means of the hysteresis action with resulting uniform tension control of the winding operation for each bobbin.

DESCRIPTION OF THE FIGURES

This invention will be better understood when taken in connection with the following description and drawings in which.

DESCRIPTION OF PREFERRED EMBODIMENTS

Figure 1:
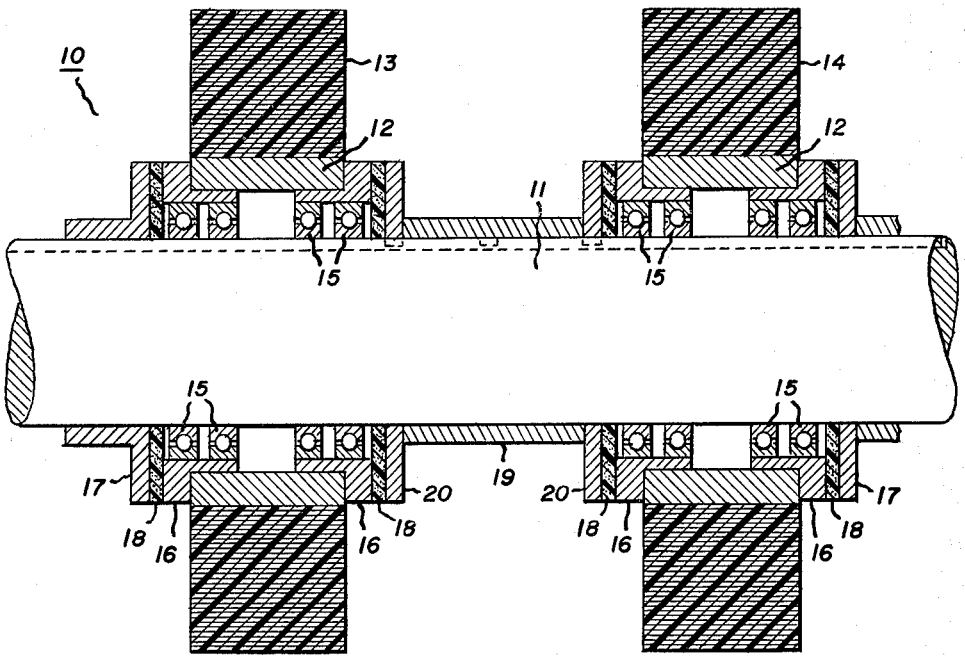
PRIOR ART FIG.1.
FIG. 1 is a schematic illustration of a prior art method of driving a winding core or core holder.

Referring now to FIG. 1, there is illustrated a drive assembly 10 which comprises a common or drive mandrel 11 which drives simultaneously two or more winding core members 12. A suitable synthetic resin film is wound on these cores to provide film bobbins 13 and 14 which for the purposes of this invention are of different widths. Each core 12 is rotatably mounted on mandrel 11 by means of suitable ball bearings 15 and core holders 16 which together permit the cores 12 to freely rotate about drive mandrel 11.

Power is transmitted from drive mandrel 11 to the cores 12 by a series of friction clutches. For example, in FIG. 1, a suitable flange clutch means 17 is adapted to be driven by drive mandrel 11 and also to be axially slideable with respect thereto. Between the flange clutch 17 and the core holder 16, there is a spacer member 18 which is usually of a low friction material such as a synthetic resin or plastic material. This spacer member 18 is free floating on drive mandrel 11. When a suitable force is applied to flange clutch 17 axially in the left to right direction, flange 17 moves into frictional engagement with spacer 18, and spacer 18 moves into frictional engagement with core holder 16 so that rotating power of drive mandrel 11 is applied to the core holder 16 to turn core holder 16 with drive mandrel 11.

In order to transmit driving torque to a plurality of, or series of, core members, and also to provide the driving torque more uniformly with respect to each bobbin, a series of friction drive means is provided between adjacent core members. For example, in FIG. 1, between each series of core holders 16, there is positioned a sleeve or spacer member 19 concentrically mounted on drive mandrel 11, and keyed to drive mandrel 11 such that slight axial motion is provided. At each end of the sleeve member 19 there are flange clutches or drive rings 20, each of which is positioned concentrically on drive mandrel 11 and keyed thereto but yet providing slight axial motion. Sleeve 19 and drive rings 20 may be combined in the form of flange clutch 17. Between the drive rings 20 and the core holders 16, there are positioned further spacer members 18.

Accordingly, flange clutch 17 is moved axially along drive mandrel 11 to frictionally engage the adjacent spacer 18 which then engages adjacent core holder 16. The core holder 16 and the bearings 15 associated therewith permit a predetermined amount of axial motion of the core holder 16 so that the other side of the adjacent core holder 16 is pressed against the further spacer member 18, and in turn the spacer member 18 is frictionally engaged with drive ring 20. Because of the permitted axial motion of the drive rings 20 and the spacers 19, the further continuing series of rings 20 and core holders 16 are brought into frictional engagement with spacer 18 so that the core holders are rotated corresponding to the rotation of drive mandrel 11. Since the driving torque of mandrel 11 is transmitted through the medium of plastic discs or spacers 18 rotating against adjacent metal surfaces of the drive rings 20 and the core holders 16, there is provided a predetermined slip clutch arrangement to accommodate non uniform driving impulses.

As noted before, the above described arrangement while ordinarily providing the required torque from the drive mandrel to the core members, also introduce a number of severe difficulties, particularly in its adaptation to winding plural bobbins of film widths less than about 15 centimeters in width and less than 12.5 microns in thickness. One difficulty is that the mechanical drive between the drive rings 20 and the core holders 16 through the friction discs 18 is not uniform and certain fluctuations in torque delivery are experienced. This fluctuation can seriously affect the required critical tension in the film being wound on the bobbin and an adverse effect on that tension will result in a poorly wound bobbin, poor bobbin edges, and perhaps wrinkling of the film. Furthermore these variations in torque which may be in the form of oscillations or jerks are then transmitted from one bobbin to another so that all bobbins are effected successfully by variations which appear in a remote bobbin. Accordingly, the preferred form of this invention, as illustrated in FIG. 2, provides for a permanent magnet hysteresis clutch to be utilized in combination with a bobbin drive assembly.

Figure 2:
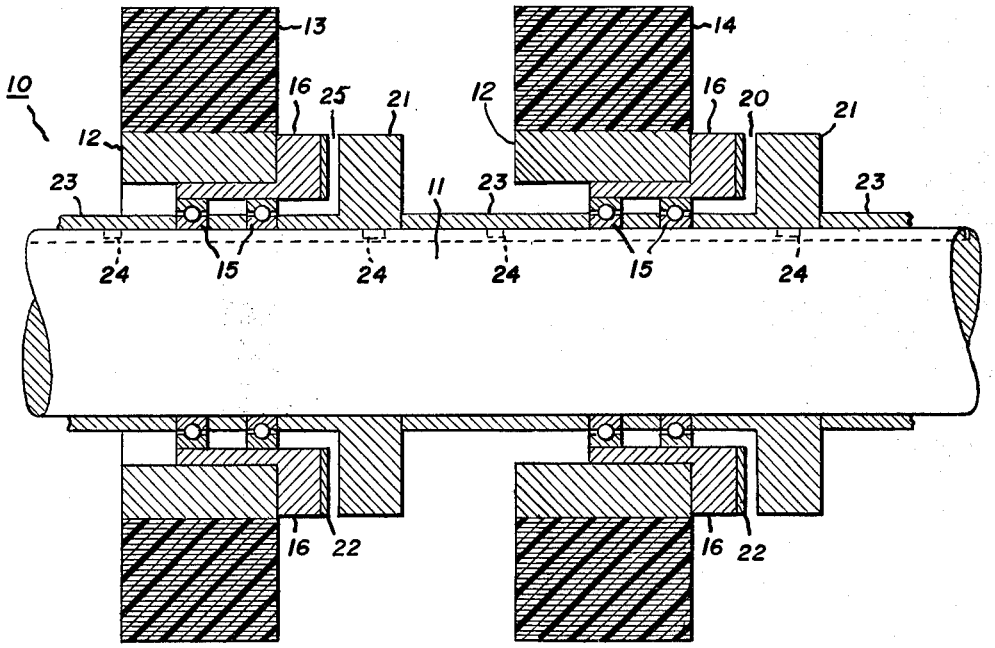
FIG. 2 is a schematic illustration of a preferred embodiment of this invention.

Referring now to FIG. 2, a hysteresis clutch assembly is provided as the drive means between the drive mandrel 11 and each of a number of successive bobbins 13 and 14. The permanent magnet hysteresis clutch in FIG. 2 comprises a magnetic clutch member 21 keyed to drive mandrel 11 and a hysteresis ring 22 which is adjacent to core holder 16. In the FIG. 2 arrangement, neither the core holder 16 nor the bearings 15 nor the clutch member 21 need to have any axial motion along the drive mandrel 11 in order to provide any driving torque. The drive means therefore for an individual core holder 16 takes place by the torque of the drive mandrel 11 being transmitted to the magnetic clutch 21 through the direct key relationship, and the magnetic clutch 21 then drives the hysteresis ring 22 through the ordinary hysteresis permanent magnet clutch arrangement to in turn drive the core holder 16. Each succeeding core holder 16 along the drive mandrel 11 is driven in the same manner. By this arrangement, the transmission of torque from the drive mandrel 11 to the cores 12 or bobbins 13 and 14 takes place in a significantly improved uniform manner, and each core 12 being driven separately from its neighbor core 12 is not affected by any fault which might appear in any core 12 along the shaft. Furthermore, there are no misalignment problems between bobbins as would be caused by one bobbin core being forced against another by a force applied at the end of a shaft on a series or stack of cores.

In the present invention as illustrated in FIG. 2, there may be several additional cores mounted on the same drive mandrel 11. However, two bobbins are not wound in side by side relationship. The webs are wound on bobbins on alternate mandrels so that at least two mandrels are required for plural strip winding. The improved drive means of this invention provides simplistic structure means to retain a series of cores in fixed spaced relationship without exerting any undue axial force on the stack or series of cores. In FIG. 2, a series of sleeve spacer members 23 of appropriate widths are positioned between core members and keyed to drive mandrel 11. If necessary, short sleeve spacer members may be provided between bearings 15. As illustrated, these sleeves bear on the inner races of the bearings 15 and on magnetic clutch member 21 so that the axial stacking force is limited to the sleeve-race-clutch structure which is a solid one with very little and insignificant axial motion of any component required. Consequently, alignment of cores is preserved mostly because no stacking force is applied to the cores. More importantly the dimensional integrity of air gap 25 is maintained to preclude driving force variations.

The tension applied to each bobbin is completely independent of any other bobbin on the mandrel because it is determined only by the setting on each permanent magnet hysteresis clutch and not by any end loading. The applied tension is extremely smooth because of the known characteristics of the permanent magnet hysteresis clutch. The clutch torques are individually adjustable from their minimum to maximum torque and consequently different tensions may be employed on different bobbins. By means of this arrangement, a greater number of bobbins may be wound in one operation, and much thinner and more narrow films can be wound without distortion. There is no wear on the driving surfaces because the driving factor is magnetic.

This invention is particularly adaptable not only to winding a plurality of different width film strips, but is highly favorable to the winding of very thin strips of very narrow widths at very light tensions.

While this invention has been disclosed with respect to particular embodiments thereof, numerous modifications may be made by those skilled in the art without departing from its true spirit and scope. Therefore, it is intended that the appended claims cover all such modifications and variations which come within the true spirit and scope of the present invention.

What is claimed as new and desired to be secured by letters Patent of the United States is:

1. A bobbin winding assembly particularly adaptable for simultaneously winding a plurality of synthetic resin strips comprising in combination a. a drive mandrel, b. a plurality of bobbin core holders coaxially mounted in spaced array along said shaft for rotation thereon, c. a hysteresis ring on each of said core holders, d. and an annular permanent magnet ring fixed concentrically to said mandrel and adjacent each hysteresis ring with an air gap therebetween and in magnetic drive relationship thereto, e. so that rotation of said drive mandrel rotates each of said core holders through said magnetic drive across said air gap.

2. A bobbin winding assembly particularly adaptable for simultaneously winding a plurality of synthetic resin strips comprising in combination a. a drive mandrel, b. a plurality of bobbin core holder concentrically positioned on said mandrel in spaced array, c. inner and outer race rolling bearing means supporting each said core holders or said mandrel to rotate thereon, d. a hysteresis ring on said core holder and concentric with said drive mandrel, e. an annular permanent magnet ring fixed concentrically on said drive mandrel adjacent said hysteresis ring to define a transverse air gap with respect to said drive mandrel, f. sleeve spacer means between said bearing means and bearing on the inner races thereof to fix said core holders in spaced array on said drive mandrel, g. so that rotation of said drive mandrel causes each of said core holders to rotate by magnetic drive through said annular magnet and said hysteresis ring.

3. The invention of claim 2 wherein said core holders are adapted to receive cores of varying widths.

4. The invention as recited in claim 2 wherein said spacer members are of predetermined length to predetermine the air gap distance between said hysteresis ring and said annular magnet.

5. The invention of claim 4 wherein said bobbins are of different widths.

6. In a bobbin winding process which comprises a. passing a strip of synthetic resin film into a slitter and slitting into a plurality of individual strips of different widths, the improvement of b. taking up each strip on a separate bobbin mounted on a plurality of mandrels, c. providing essentially identical permanent magnet hysteresis drive means between said mandrel and each of said bobbins, d. and driving said mandrels so that said permanent magnet drive means drives said bobbins simultaneously at different speeds.

* * * * *